US007611131B2

(12) United States Patent
Engman et al.

(10) Patent No.: US 7,611,131 B2
(45) Date of Patent: Nov. 3, 2009

(54) CARBURETOR START-STOP MECHANISM

(75) Inventors: Thomas Engman, Mullsjö (SE); Carl-Johan Arnesson, Gränna (SE); Göran Dahlberg, Gränna (SE); Gustaf Döragrip, Jönköping (SE); Kenth Gustavsson, Jönköping (SE); Mats Gustavsson, Huskvarna (SE)

(73) Assignee: Husqvarna AB, Huskvarna (SE)

( * ) Notice: Subject to any disclaimer, the term of this patent is extended or adjusted under 35 U.S.C. 154(b) by 0 days.

(21) Appl. No.: 12/098,444

(22) Filed: Apr. 6, 2008

(65) Prior Publication Data

US 2008/0246170 A1 Oct. 9, 2008

Related U.S. Application Data

(63) Continuation of application No. PCT/SE2006/000830, filed on Jul. 3, 2006.

(30) Foreign Application Priority Data

Oct. 7, 2005 (SE) ..... PCT/SE2005/001491

(51) Int. Cl.
*F02M 1/02* (2006.01)

(52) U.S. Cl. ..... 261/64.1; 261/64.6

(58) Field of Classification Search ..... 261/64.1, 261/64.2, 64.6; 123/198 R
See application file for complete search history.

(56) References Cited

U.S. PATENT DOCUMENTS 1,107,713 A * 8/1914 Shakespeare, Jr. et al. . 261/50.1
1,493,975 A * 5/1924 Folberth et al. ..... 137/583
1,518,061 A * 12/1924 Gibford et al. ..... 137/479
1,995,587 A * 3/1935 Schuttler ..... 261/50.1
2,281,285 A * 4/1942 Hammond ..... 477/109
2,394,665 A * 2/1946 Christian ..... 261/39.3
2,538,570 A * 1/1951 Kittler ..... 261/39.3
2,764,393 A * 9/1956 Geyer ..... 261/64.6
2,982,275 A * 5/1961 Doman et al. ..... 123/198 DC
3,147,320 A * 9/1964 Tubb ..... 261/51

(Continued)

FOREIGN PATENT DOCUMENTS

EP 0691468 B1 10/1996

(Continued)

OTHER PUBLICATIONS

International Search Report dated Oct. 10, 2006, from the International Application PCT/SE2006/000830.

(Continued)

*Primary Examiner*—Richard L Chiesa
(74) *Attorney, Agent, or Firm*—Novak Druce + Quigg LLP

(57) ABSTRACT

The present invention relates to a carburetor of an internal combustion engine having a manually activated start position. The carburetor includes at least a choke valve and a throttle valve both located in the carburetor's main air passage which are able to move between an open and a closed position, each valve having at least one respective lever that cooperates during the manual activation to give at least one start position of the choke and throttle valves. The carburetor further usually includes at least one thermally responsive member arranged to affect the start position. Further a handle is arranged to provide a two stage draw—lift motion to attain the start position.

6 Claims, 12 Drawing Sheets

U.S. PATENT DOCUMENTS

| | | | | | |
|---|---|---|---|---|---|
| 3,823,700 | A | * | 7/1974 | Gumtow | 123/395 |
| 3,928,511 | A | * | 12/1975 | Atsumi et al. | 261/64.4 |
| 3,948,240 | A | * | 4/1976 | Hirosawa et al. | 123/179.16 |
| 4,031,872 | A | | 6/1977 | Thompson et al. | |
| 4,079,708 | A | | 3/1978 | Wieland et al. | |
| 4,462,945 | A | * | 7/1984 | Brown et al. | 261/50.1 |
| 5,215,049 | A | * | 6/1993 | Wolf | 123/179.18 |
| 5,927,241 | A | | 7/1999 | Dahlberg et al. | |
| 6,145,487 | A | | 11/2000 | Dykstra et al. | |
| 6,454,245 | B2 | * | 9/2002 | Kobayashi | 261/52 |
| 6,871,623 | B2 | | 3/2005 | Ohsawa et al. | |
| 7,104,527 | B2 | * | 9/2006 | Koizumi | 261/52 |
| 7,156,376 | B2 | * | 1/2007 | Bungo et al. | 261/64.1 |
| 7,344,125 | B2 | * | 3/2008 | Matsuda et al. | 261/64.1 |
| 2004/0017015 | A1 | * | 1/2004 | Warner | 261/64.6 |
| 2005/0022798 | A1 | | 2/2005 | Roth et al. | |

FOREIGN PATENT DOCUMENTS

| | | | | | |
|---|---|---|---|---|---|
| GB | 2180006 | A | * | 3/1987 | 261/64.1 |
| WO | 9641941 | A1 | | 12/1996 | |

OTHER PUBLICATIONS

International Search Report dated May 8, 2006, from the International Application PCT/SE2005/001491.

* cited by examiner

CARBURETOR START-STOP MECHANISM

CROSS-REFERENCE TO RELATED APPLICATIONS

The present application is a continuation patent application of International Application No. PCT/SE2006/000830 filed 3 Jul. 2006, published as WO 2007/043930 A1, which was published in English pursuant to Article 21(2) of the Patent Cooperation Treaty, and which claims priority to International Application No. PCT/SE2005/001491 filed 7 Oct. 2005, published as WO 2007/043916 A1, which was also published in English pursuant to Article 21(2) of the Patent Cooperation Treaty. Said applications are expressly incorporated herein by reference in their entireties.

TECHNICAL FIELD

The present invention relates to a carburetor of an internal combustion engine having a manually activated choke. The carburetor comprises at least a choke valve and a throttle valve both located in the carburetor's main air passage which are able to move between an open and a closed position, each valve cooperates with at least one respective lever.

BACKGROUND

Two-stroke conventional internal combustion engines with carburetors are used in many different areas. One is in chainsaws, which are commonly used outside in forest working characterized by a large variation in climate. The engine therefore has for instance to manage to be run at high speed, in cold climate and in rain. In such use the functionality of the carburetor is very important. It has to provide the right amount of fuel to the engine in relation to different conditions. The fuel/air ratio is important for the operation of the engine, and depends on temperature, pressure, engine speed and load. The carburetor is therefore calibrated at manufacturing to be able to provide, at the engines operating point, the right amount of fuel and air in order for the engine to operate properly.

The operating point is related to operation where the engine has reached its operating temperature. The carburetors calibration is based on such an operating state. On the other hand, when the engine is cold and about to be started, the calibration will not be able provide sufficient conditions for that. Therefore the carburetor is equipped with a choke to increase the fuel ratio in the engine to enable it to start. The fuel/air mixture is enriched.

The invention concerns the kind of carburetors where engaging the choke also affects the throttle valve to open somewhat providing a starting throttle. Thus the normal starting position is a closed choke valve and a slightly opened throttle valve.

In many carburetors the choke valve and the throttle valve have one respective lever which can be interlocked during the start of the engine providing starting position of the throttle valve and the choke valve. The choke valve lever is controlled in one rotational direction by a choke valve conveyor, and the choke valve axle can be held in two detent positions, a first detent position of closed choke valve and a second detent position of open choke valve. This is often implemented by having a spring pressing a ball towards a suitably placed bowl formed notched on the choke valve axle, one notch for the first detent position and a second notch for the second detent position. During normal engine running the choke valve is held stable in the second detent position of opened choke valve and at start the choke valve is normally held in the first detent position. However, in many situations it is desirable to start the engine without choke, i.e. the second detent position, but with a start throttle. When the throttle wire is activated after the start of the engine the interlock between the throttle valve lever and the choke valve lever is released. Often both the throttle valve lever and the choke valve lever are spring loaded towards opened choke valve respective closed throttle valve. Thus when the interlock is released the choke valve spring acts to open the choke valve, however, the choke valve spring must overcome the friction of the first detent position to move the choke valve from closed to opened. If this friction is not overcome the choke valve remains closed after the throttle wire is activated, which is undesirable.

One problem with these conventional manual chokes is that its functionality is very much related to the engines temperature at start. During a warmer climate, for instance above zero degrees Celsius, the engine needs less fuel in order to start. The needed fuel/air enrichment for the engine to start goes down when the temperature goes up. Despite the temperature variations at use, the choke is designed to provide a maximum fuel/air ratio that is needed at a very low temperature.

When the worker pulls the starting cord he/she has to recognize that the engine ignites. Every new pull will increase the enrichment in the engine and if the worker does not deactivate the choke after ignition, the enrichment will reach such a high level that the engine cannot start. The higher the temperature, the bigger the risk this will happen. An object of the present invention is therefore to provide a choke for a carburetor internal combustion engine, which is designed to consider the variations in climate where the engine is used.

Further there is a demand to have chain saws where the two separate motions are required to set the start position and it is an object of the invention to present a choke actuator needing two separate motions to arrive at the start position of slightly opened throttle valve and closed choke valve.

Another object of the invention is to provide a low friction arrangement for the first detent function. And further to provide a simplified implementation of the detent positions.

SUMMARY OF THE PRESENT INVENTION

The present invention relates to a carburetor of an internal combustion engine having a manually activated start position. The carburetor comprises at least a choke valve and a throttle valve, both located in the carburetor's main air passage, which are able to move between an open and a closed position, each valve cooperates with at least one respective lever. The carburetor further comprises at least one thermally responsive member. In the present invention said member influences the air through-flow resistance in said passage when the choke is made active by arranging the member so that it at certain temperatures restricts said movement of said choke valve towards closed position.

The invention further relates to a carburetor of an internal combustion engine, in particular of a chainsaw, comprising at least a choke valve and a throttle valve, both located in the carburetor's main air passage. The throttle valve comprises a throttle valve axle connected to at least a throttle valve lever. The choke valve comprises a choke valve axle connected to at least a choke valve conveyor cooperating with a choke valve lever. The throttle valve lever and the choke valve lever can be set to be interlocked to each other in at least one interlock position in which the throttle valve is partly opened providing a start position of the throttle. When in the at least one interlock position, the choke valve axle can be held in at least two separate detent positions by at least one detent holding means or detent holder, wherein a first detent position corresponds to a substantially closed choke valve and a second detent position corresponds to an open choke valve. The first detent holding means or holder is provided on the choke valve lever in the form of a hook holding the choke valve conveyor in a position corresponding to the first detent position. The grip of the hook is arranged to prevent the choke valve conveyor from moving from the first detent position due to vibrations at engine start.

The disclosure further relates to a method of using a choke actuator of an internal combustion engine. The choke actuator controls the choke valve of a carburetor of the engine by pivoting the choke actuator. The choke valve cooperates with a throttle valve through at least one respective lever. A base position of opened choke valve and a closed throttle valve correspond to the choke actuator being in a first choke actuator position and a first start position of closed choke valve and a partly opened throttle valve correspond to the choke actuator being in second choke actuator position. In the first start position the choke valve and the throttle valve are interlocked through cooperation of the levers where the choke actuator is actuated according to the followings steps in order for the throttle and choke valves to move from the base position to the first start position: a) pulling an choke actuator handle of the choke actuator outwards releasing a locking sprint, the locking sprint in locked position preventing pivoting in a first rotational direction; b) pivoting the choke actuator to the second choke actuator position thereby closing the choke valve which closing choke valve interacts with the throttle valve to interlock providing the first start position.

DESCRIPTION OF THE DRAWINGS

The invention will now be described further with reference to the accompanying drawings, in which.

DETAILED DESCRIPTION

Figure 11:
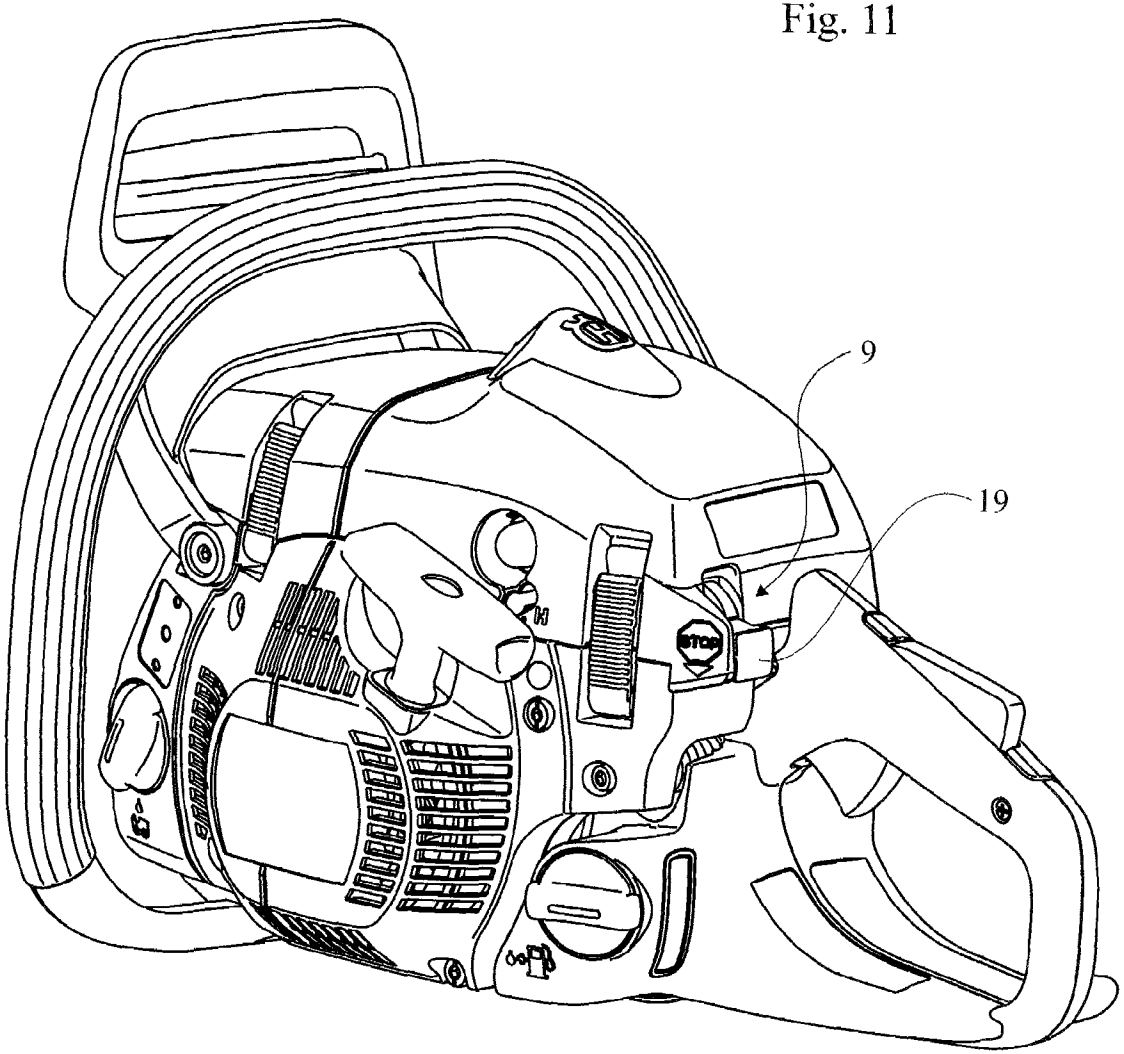
FIG. 11 shows the choke actuator of a chainsaw.

FIG. 11 shows a chainsaw, without the sword visible, where a manually actuated choke actuator can be seen. The manually actuated choke actuator controls the start position of a carburetor in an internal combustion engine of the chainsaw.

Throughout the specification, rotational directions of counter clockwise and clockwise are referred to as interpreted in the view of FIG. 7-10, which provide the opposite side of view of FIG. 3-6.

Figure 1:
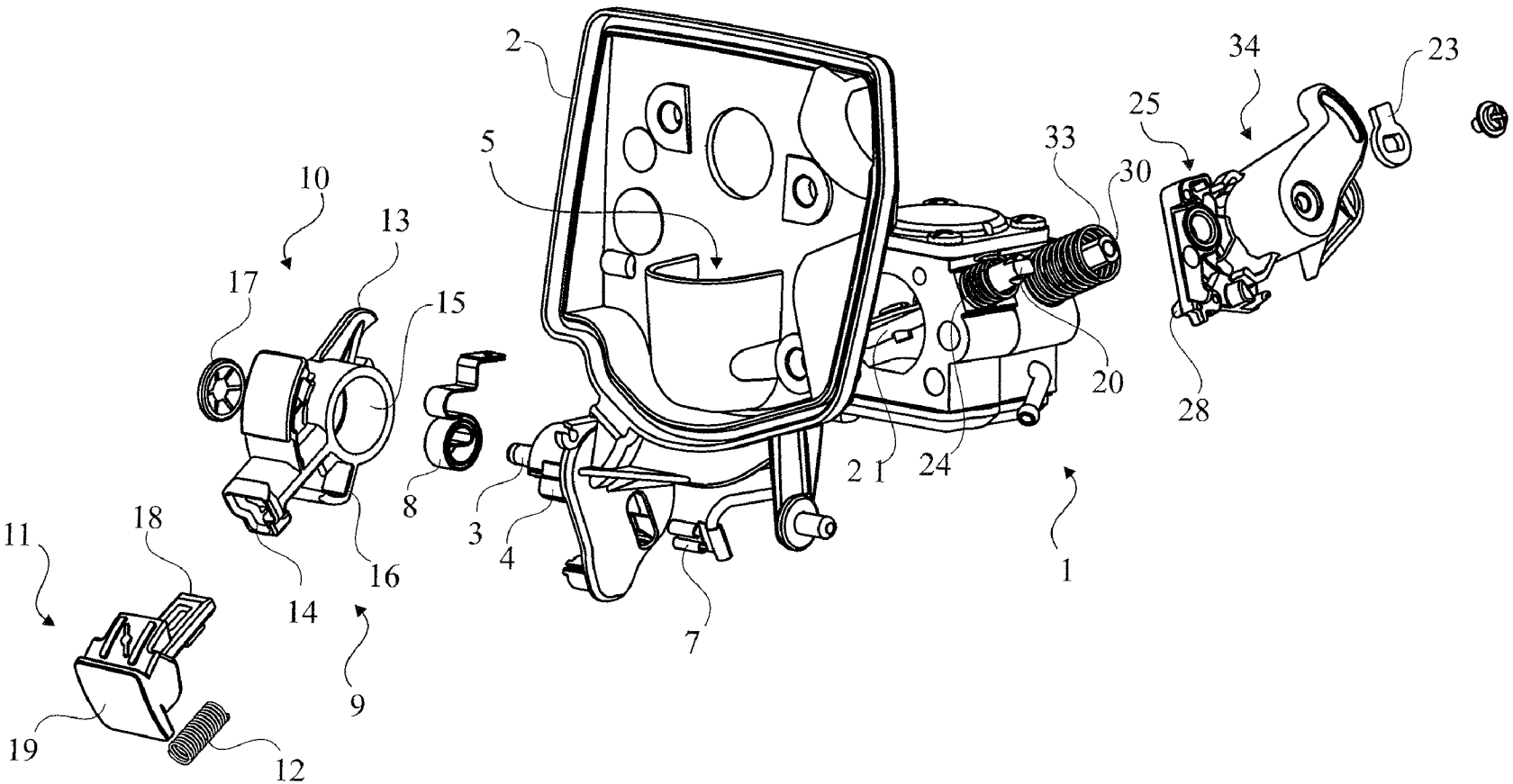
FIG. 1 is an exploded perspective view of a carburetor, a filter holder and a choke actuator in accordance with a preferred embodiment of the invention.

In the exploded view of FIG. 1 the choke actuator 9, the filter holder 2 and the carburetor 1 can be seen. The present invention relates to the choke actuator 9 and how it is operated. It further relates to a temperature dependent interaction in a starting position between the choke valve and the throttle valve of the carburetor 1, in particular the interaction between the choke valve lever 25 and the throttle valve lever 34. It further concerns a substantially friction free detent function of the choke valve.

The choke actuator 9 comprises a choke actuator body 10, a choke actuator handle 11, a compression choke actuator spring 12 and a securing ring 17. The choke actuator body 10 comprises an open cylindrical interior 15, a sprint passage 14 accessing the cylindrical interior 15, a connecting claw 13 and a pressing member 16. The choke actuator handle 11 comprises an externally accessible handle portion 19, accessible from the outside of a machine it is installed in e.g. a chain saw, and a handle rod 18.

Figure 3:
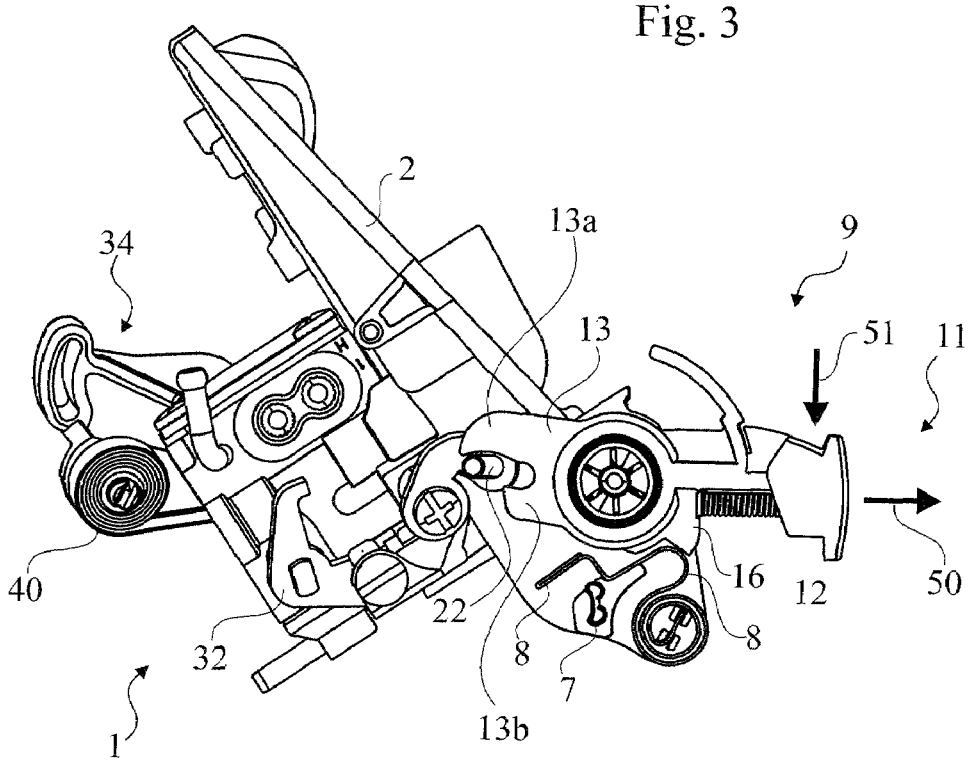
FIG. 3 is a side view of the carburetor, the filter holder and the choke actuator in its locked position.
Figure 3A:
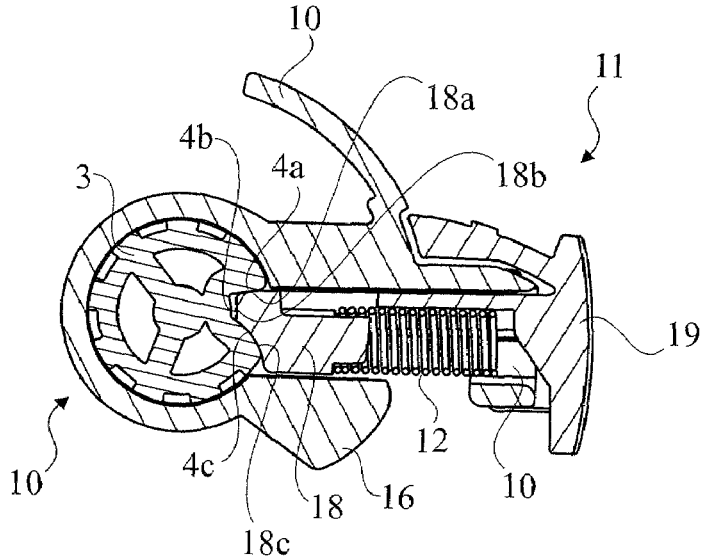
FIG. 3A is a cut out cross section of the choke actuator and the cylindrical holder in the state of FIG. 3.
Figure 4:
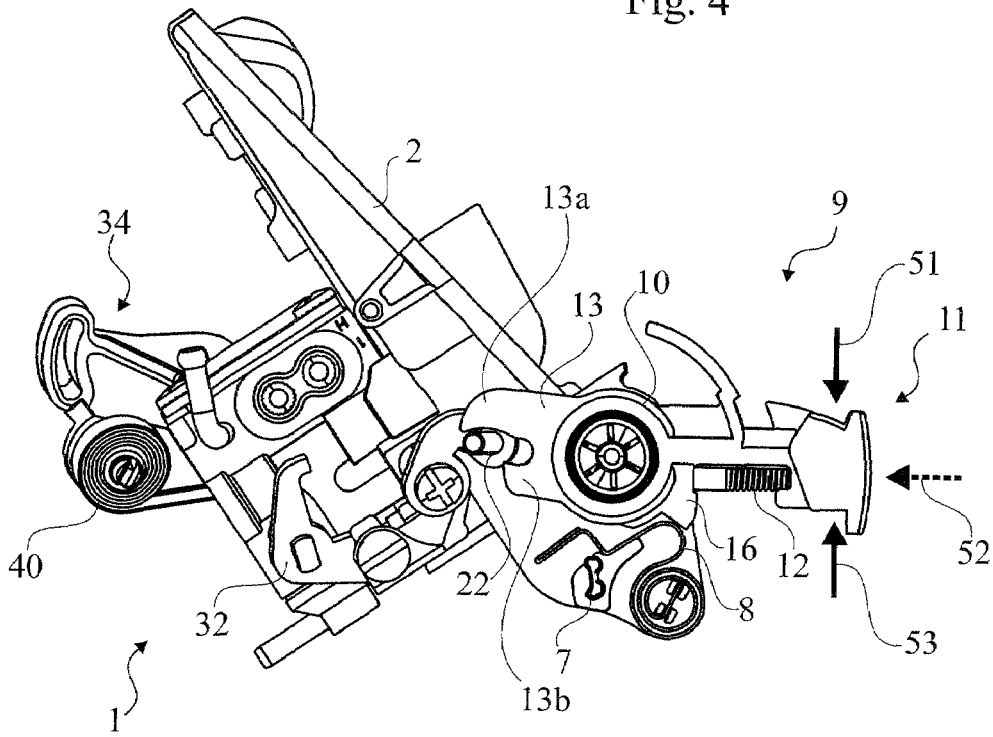
FIG. 4 is a side view over the carburetor, the filter holder and the choke actuator, where the handle portion of the choke actuator is pulled out.
Figure 4A:
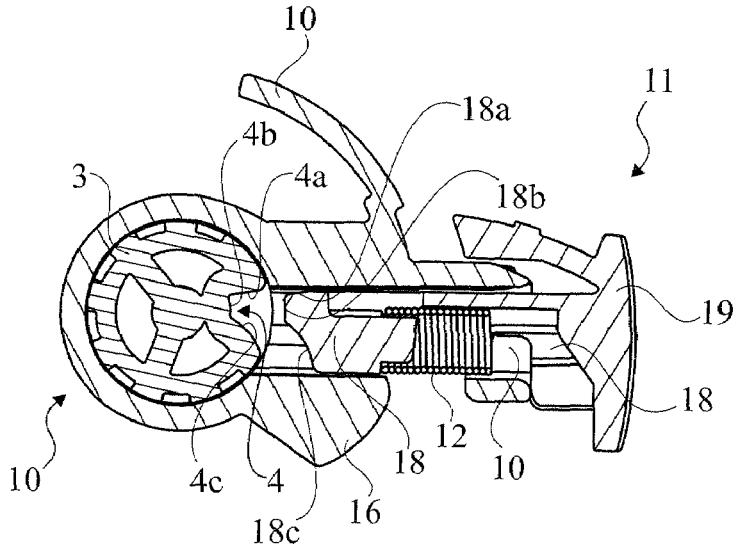
FIG. 4A is a cut out cross section of the choke actuator and the cylindrical holder in the state of FIG. 4.
Figure 5:
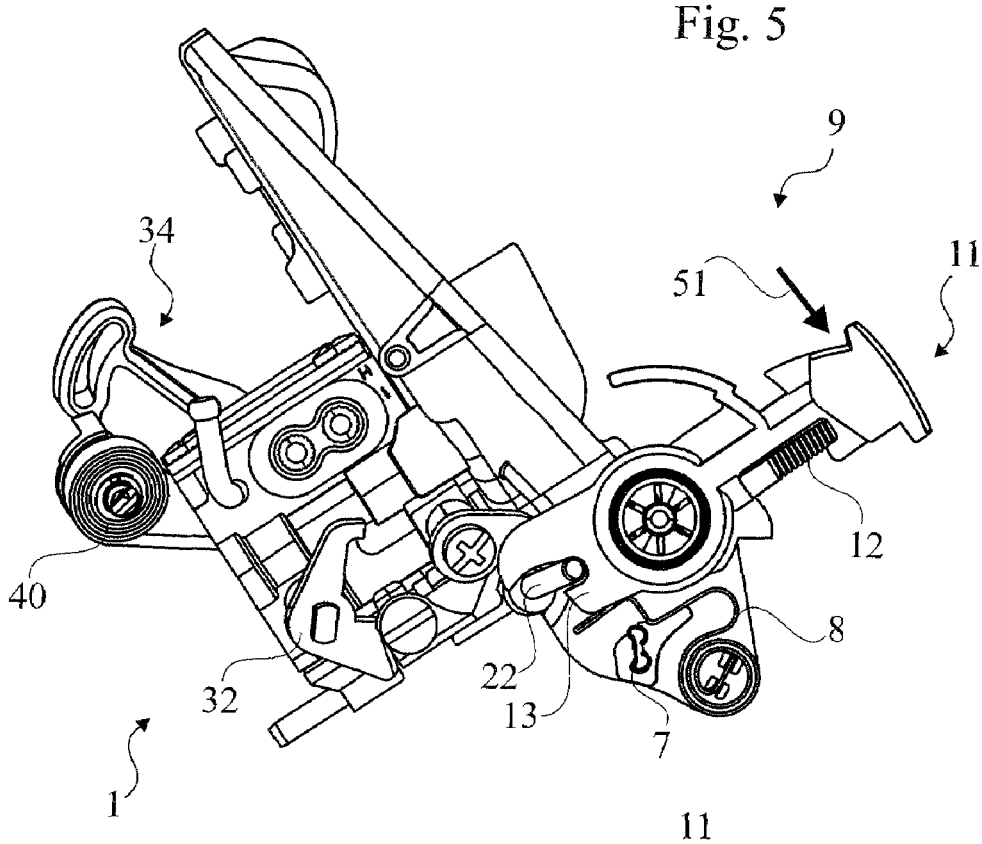
FIG. 5 is a side view of the carburetor, the filter holder and the choke actuator, where the choke actuator is in choke position.
Figure 5A:
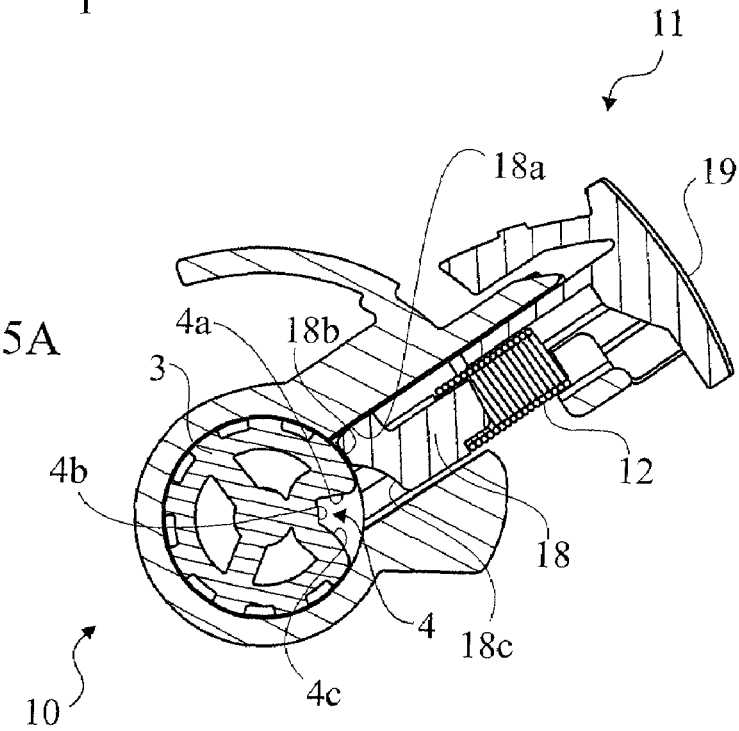
FIG. 5A is a cut out cross section of the choke actuator and the cylindrical holder in the state of FIG. 5.

In FIG. 3A, 4A, 5A a cross section of the actuator handle 11 a cylindrical holder 3 of the filter holder 2 can be seen. The free end of the handle rod 18 have an upper locking sprint surface 18*a* aligned with the extension of the handle rod 18, a tilted lower locking sprint surface 18*c* tilting at a direction inwards towards the handle portion 19 and downwards away from the upper locking sprint surface 18*a* and an intermediate sprint surface 18*b* transversal to the extension of the handle rod 18 connecting the upper and the lower sprint surfaces 18*a*, 18*c*. Preferably the lower locking sprint surface 18*c* is slightly convex.

Figure 2:
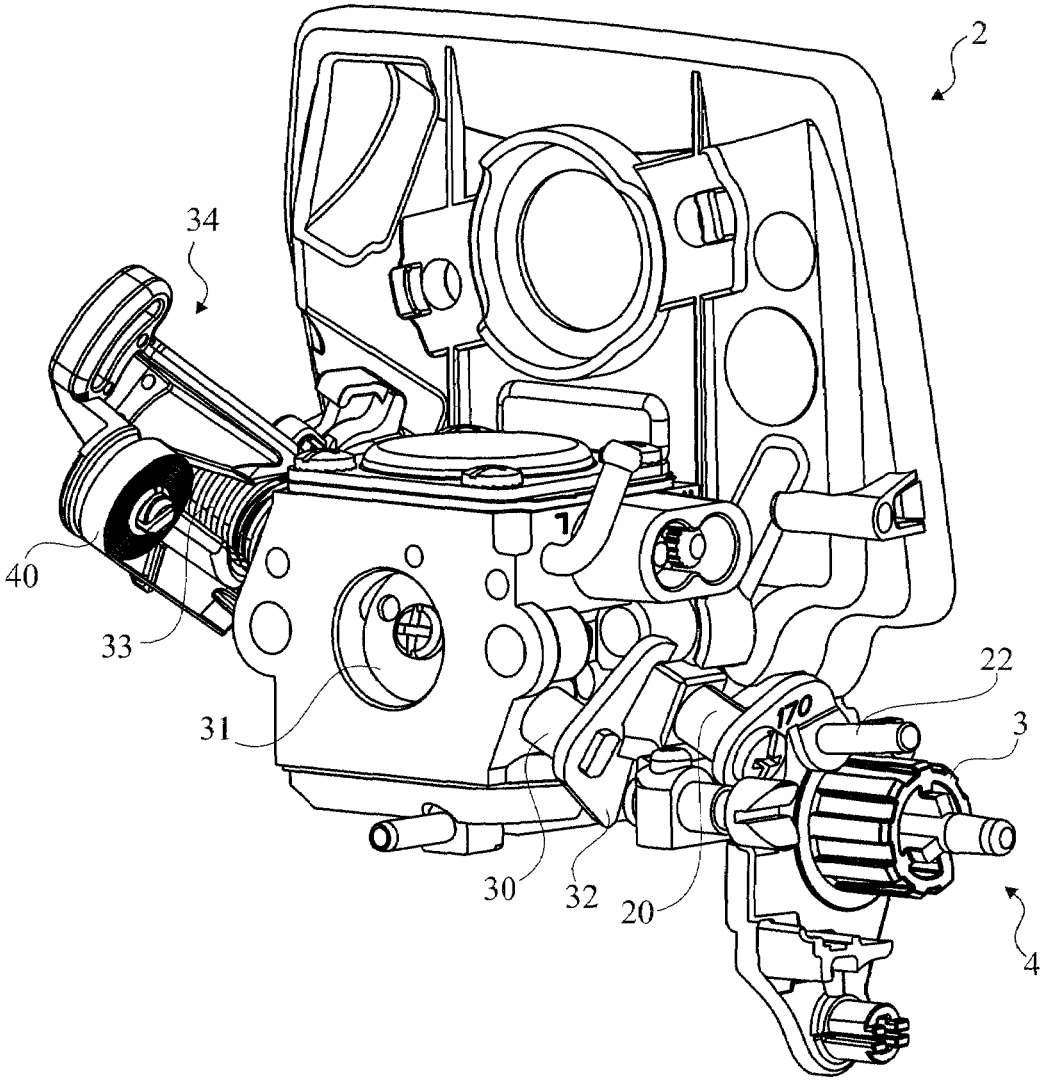
FIG. 2 is a perspective view of a carburetor and a filter holder without the choke actuator.

The filter holder 2 and the carburetor 1 are mounted together as seen in e.g. FIG. 2. The filter holder comprises an air inlet 5, see FIG. 1, supplying air to the carburetor's 1 main air passage and the cylindrical holder 3 having a holder notch 4. The holder notch 4 has a corresponding inverted or mating configuration 4*a*, 4*b*, 4*c* as to the free end 18*a*, 18*b*, 18*c* of the handle rod 18, and comprises an upper holder notch surface 4*a* interacting with the upper locking sprint surface 18*a* in locked position to prevent a clockwise rotation of the choke actuator, an intermediate holder notch surface 4*b*, and a lower holder notch surface 4*c* interacting with the lower locking sprint surface 18*c* when the choke actuator 9 is pushed downwards, i.e. an counter clockwise pivoting of the choke actuator 9. The upper locking sprint surface 18*a* extends inwards from the perimeter of the cylindrical holder 3 at an approximately right angle to the perimeter. The intermediate holder notch surface 4*b*, extending downwards at an approximately right angle to the inner end of the upper holder notch surface 4*a*. The lower holder notch surface 4*c* extending from the lower end of the intermediate holder notch surface 4*b* towards the perimeter of the cylindrical holder 3. The angle between the intermediate holder notch surface 4*b* and the lower holder notch surface should be larger than 90° and less than 180°, preferably around 135°, whereby the angle to the perimeter is less than 90°, preferably around 45°. The angles between the surfaces 4*a*, 4*b*, 4*c* are in relation to the open area of the notch.

Electrical contacts, first contact 7 and recoiling contact 8, are mounted on the filter holder 2. The choke actuator body 10 is, through its cylindrical interior 15, mounted around the cylindrical holder 3 and fixed to cylindrical holder 3 by the securing ring 17 but free to pivot around cylindrical holder 3.

The handle rod 18 of the choke actuator handle 11 is inserted in the sprint passage 14 of the choke actuator body 10. The compression spring 12 is mounted between a first spring retainer of the handle rod 18 and a second spring retainer of the choke actuator body 10, see FIG. 5A. The compression spring 12 presses the choke actuator handle 11 towards the cylindrical holder 3. Pulling the choke actuator handle 11 outwards the compression spring 12 is compressed.

The connecting claw 13 of the choke actuator body 10 comprising an upper part 13*a* and a lower part 13*b*. The upper part 13*a* of the connection claw 13 has a length extension of approximately twice the length of the lower part 13*b*. As can be seen in FIG. 3-6 the upper part 13*a* of the connection claw 13 is on top of the choke valve linkage arm 22 in all choke actuator positions expect for the position of FIG. 6. On the other hand the lower part 13*b* of the connection claw is only active in the position seen in FIG. 5. In this configuration, pivoting the choke actuator 9 counter clockwise, affects the choke valve axle 20 to a clockwise rotation via the choke valve linkage arm 22.

The carburetor 1 comprises a choke valve and a throttle valve. The choke valve having a choke valve plate 21 on a choke valve axle 20 and the throttle valve having a throttle valve plate 31 on a throttle valve axle 30. The valves open and close as axle 20 and axel 30, respectively, are turned. The choke valve plate 21 is preferably firmly secured to the choke valve axle 20.

The choke valve is controlled by the choke actuator 9 affecting a choke valve linkage arm 22 fixed, at one side of the carburetor 1, to follow the rotation of the choke valve axle 20. At the opposite side of the carburetor 1*a* choke valve lever 25 is mounted around the choke valve axle 20, so that the choke valve lever 25 itself is free to rotate in relation the choke valve axle 20. A choke valve conveyor 23 is fixed to follow the rotation of the choke valve axle 20 and controls the choke valve lever 25. A choke valve return spring 24, preferably a torsion spring, is fixed at one end to the main body of the carburetor 1 and at the other end to the choke valve lever 25, spring-loading it.

The throttle valve is controlled by the throttle valve lever 34. The throttle valve axle 30 is fixed to follow the rotation of the throttle valve lever 34. A throttle valve return spring 33, preferably a torsion spring, is fixed at one end to the main body of the carburetor 1 and at the other end to the throttle valve lever 34, spring-loading it.

Figure 7:
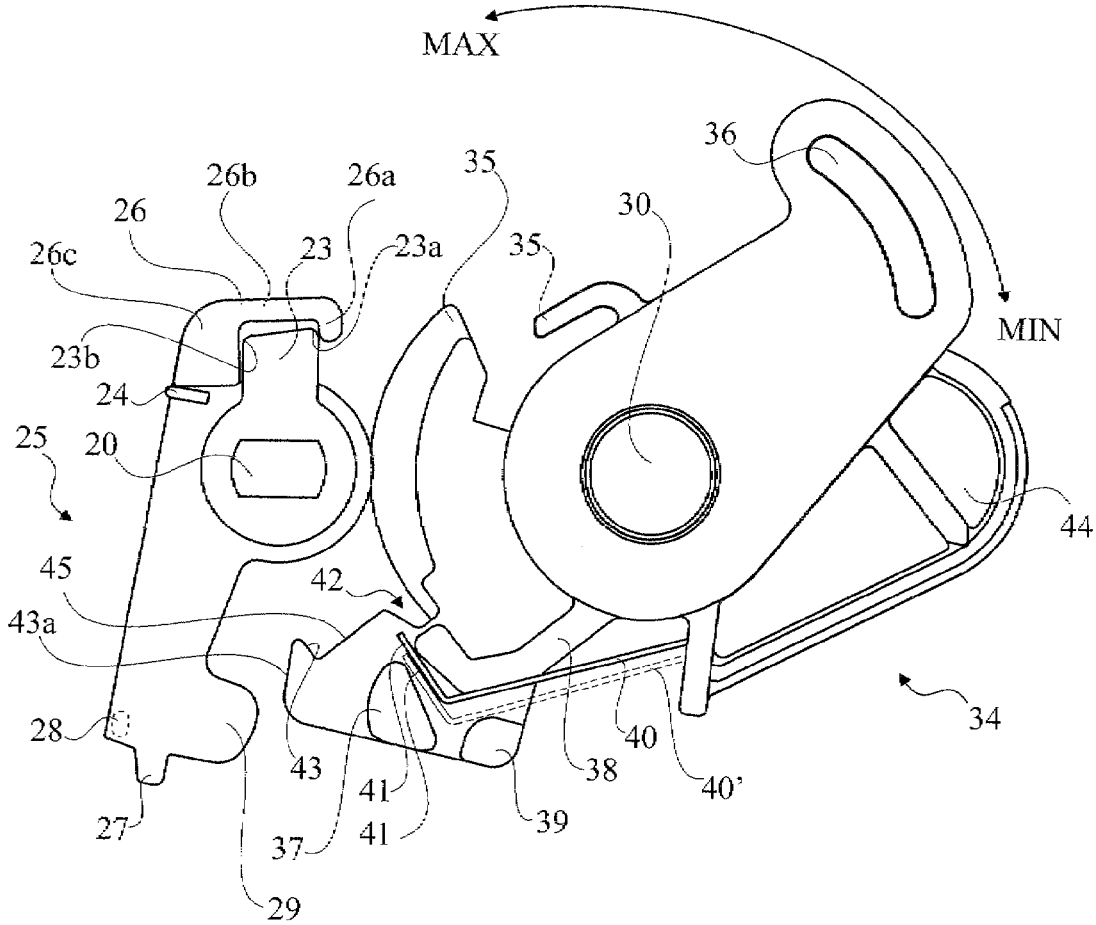
FIG. 7 shows the choke valve lever and the throttle lever in the positions of fully opened choke valve and closed throttle valve.

FIG. 7 shows the choke valve lever 25 and the throttle lever 34 in the positions of fully opened choke valve and closed throttle valve. The throttle valve lever 34 is fixed to follow the rotation of the throttle valve axle 30 and is spring loaded through the throttle valve return spring 33 (seen in FIG. 1). The throttle valve return spring 33 acts for a clockwise rotation around the center of the throttle valve axle 30. I.e., when the throttle valve lever 34 is not actively actuated through a throttle wire or the choke valve lever 25 and the throttle valve lever 34 is not interlocked, the spring-load will make the throttle valve lever 34 to rotate back to the closed position. The throttle valve lever 34 is shown at its minimum position MIN in the figure. Overcoming the retaining spring force, the throttle valve lever 34 moves counter clockwise towards its maximum position MAX, i.e., fully opened throttle valve. The MIN and MAX positions are defined by a conventional throttle max/min limiter arm 32 (see e.g. FIG. 4) at the opposite side of the carburetor 1 connected via the throttle valve axle 30. The parts labelled 35 of the throttle valve lever 34 relate to attachments for the throttle wire and are of no concern of the invention. The banana shaped hole labelled 36 is for attaching a linkage to an additional air vault, but the invention is not limited to a carburetor arrangement comprising an additional air vault. The throttle valve lever 34 further comprises a thermally responsive member 40 which is partly hidden by the part labelled 44. The thermally responsive member is preferably a coil spring for instance made as a bimetal or memory metal sheet. It is attached at one end to the throttle valve lever 34, at the opposite side of the part labelled 44 as can be seen in FIG. 2, and it will therefore move together with said lever 34. The coil springs free end 41 is arranged between three supports 37, 38, 39 formed as heels. When the temperature changes the thermally responsive member 40 will reshape. The dashed lines labelled 40' indicate how the coil spring retracts when the temperature is low. A higher temperature causes the free end 41 to move to the position indicted by the full lines labelled 40. The throttle valve lever 34 further comprises an interlocking notch 42 and an interlocking hook 43.

The choke valve lever 25 is spring-loaded by the choke valve return spring 24, acting for a clockwise rotation around the center of the choke valve axle 20. The choke valve lever 25 is in it self fixed to follow the rotation of the choke valve axle 20 and rotates freely about the center of the choke valve axle 20. A choke valve conveyor 23 is however fixed to follow the rotation of the choke valve axle 20 and it interacts with the choke valve lever 25. Further, the choke valve linkage arm 22 (see e.g. FIG. 2) is fixed to follow the rotation of the choke valve axle 20, i.e. actuating the choke valve linkage arm 22 affects the choke valve conveyor 23

The choke valve conveyor 23 has roughly the shape of an hour hand and the choke valve lever 25 of a minute hand. In, FIG. 7, a detent hook 26 of the choke valve lever 25 grasps the choke valve conveyor 23 in a first detent position, where the hour hand and the minute hand are opposite each other. When the choke valve conveyor 23 points at around twelve o'clock, as of FIG. 7, the choke valve is open, and when the choke valve conveyor 23 points at around ten o'clock, as of FIG. 9, the choke valve is closed. The choke valve plate 21 is limited to rotate beyond a closed position and can neither rotate beyond a fully opened position.

The detent hook 26 comprises a firm portion 26*c* preventing the choke valve conveyor 23 to further rotate counter clockwise in relation to the choke valve lever 25, as the choke valve conveyor 23 is in the first detent position, i.e. when choke valve conveyor 23 is in the first detent position and it is rotated counter clockwise—the choke valve lever 25 follows the counter clockwise rotation. This occurs when the choke actuator 9 is pivoted from the position of FIG. 3 to the position of FIG. 5. The detent hook 26 further comprises a flexible arm portion 26*b* connecting a hook tab 26*a* to the firm portion 26*c*. The hook tab 26*a* is active when the choke valve conveyor is rotated clockwise. When the choke valve lever 25 and the throttle valve lever 34 are interlocked as described below and the engine is started—vibrations may cause the choke valve axle 20 to try to rotate clockwise. The hook tab 26*a* and the flexible arm 26*b* prevent the choke valve conveyor 23 from eluding the first detent position due to vibrations. However, if the clockwise turning force is large enough the flexible arm 26*b* will flex out as a first corner 23*a* of the choke valve conveyor 23 pushes the hook tab 26*a*, whereby the choke valve conveyor 23 enters a second detent position indicated by the dashed lines labelled 23' in FIGS. 9 and 10. Of course the force needed to flex out the flexible arm 26*b* must be smaller than a force breaking the interlock. This occurs when the choke actuator 9 is pivoted back from the position of FIG. 5 to the position of FIG. 3. I.e., the choke valve is opened while the interlock between the choke valve lever 25 and the throttle valve lever 34 is maintained.

When the choke valve linkage arm 22 is not actively actuated nor the choke valve lever 25 and the throttle valve lever 34 interlocked (as described below), the spring-load will make the choke valve lever 25 to rotate back, whereby the choke valve conveyor 23 is forced to follow the rotation if in the first detent position or is forced into the first detent position if the choke valve conveyor 23 is in the second detent position. By having the longitudinal side ending in the second corner 23*b* slightly shorter than the longitudinal side ending in the first corner 23*a*, re-entering the first detent position is facilitated. Thus the choke valve lever 25 and the choke valve conveyor returns to the position of FIG. 7.

The choke valve lever 25 further comprises a pushing tab 29, a stopping tab 27 and a securing tab 28 indicated by the dashed lines. The pushing tab 29 extends transversally from the free end of the choke lever 25 in a direction towards the throttle valve lever 34. The stopping tab 27 is a pointed extension in the longitudinal direction at the free end of the choke lever 25, i.e. the point of the minute hand. The securing tab 28 extends, at the free end of the choke lever 25 perpendicular in relation to the plane of FIG. 7-10 towards the carburetor body, i.e. from the backside of the choke valve lever 25 as partly seen in FIG. 1.

Consider when the temperature of the engine and the surroundings are normal or warm, e.g. about or above −8 degrees Celsius (the degree limit is an example and can be as an alternative be warmer or colder). The higher the temperature, the greater the risk that the user pulls the start wire so that the enrichment gets too high. This means that the engine may not be able to start at all. If the user does not deactivate the choke after the first ignition, there is a high likelihood that this will happen. Therefore the choke is limited to a first stable interlocking position (see FIG. 9) providing less choke (slightly opened choke valve) than a second stable interlocking position (see FIG. 10) providing full choke (closed choke valve). More air will therefore flow into the carburetor air passage and decrease the fuel/air enrichment. In both interlocking positions the throttle valve is slightly opened providing a starting throttle. After start when the throttle valve lever 34 is activated by the user, the spring loaded choke valve lever 25 will be released and rotate back to its original position. The result of this partly open choke valve is that there is a lower risk that the engine will get a too high enrichment before it starts. Even if the user misses to deactivate the choke, the engine will probably start before the enrichment gets too high because of the partly open choke valve.

When the temperature of the engine and the surroundings is for instance is about or below −8 degrees Celsius (the degree limit is an example and can be as an alternative be warmer or colder), the choke is increased to full choke, i.e. closed choke valve, at a second stable interlocking position.

Figure 8:
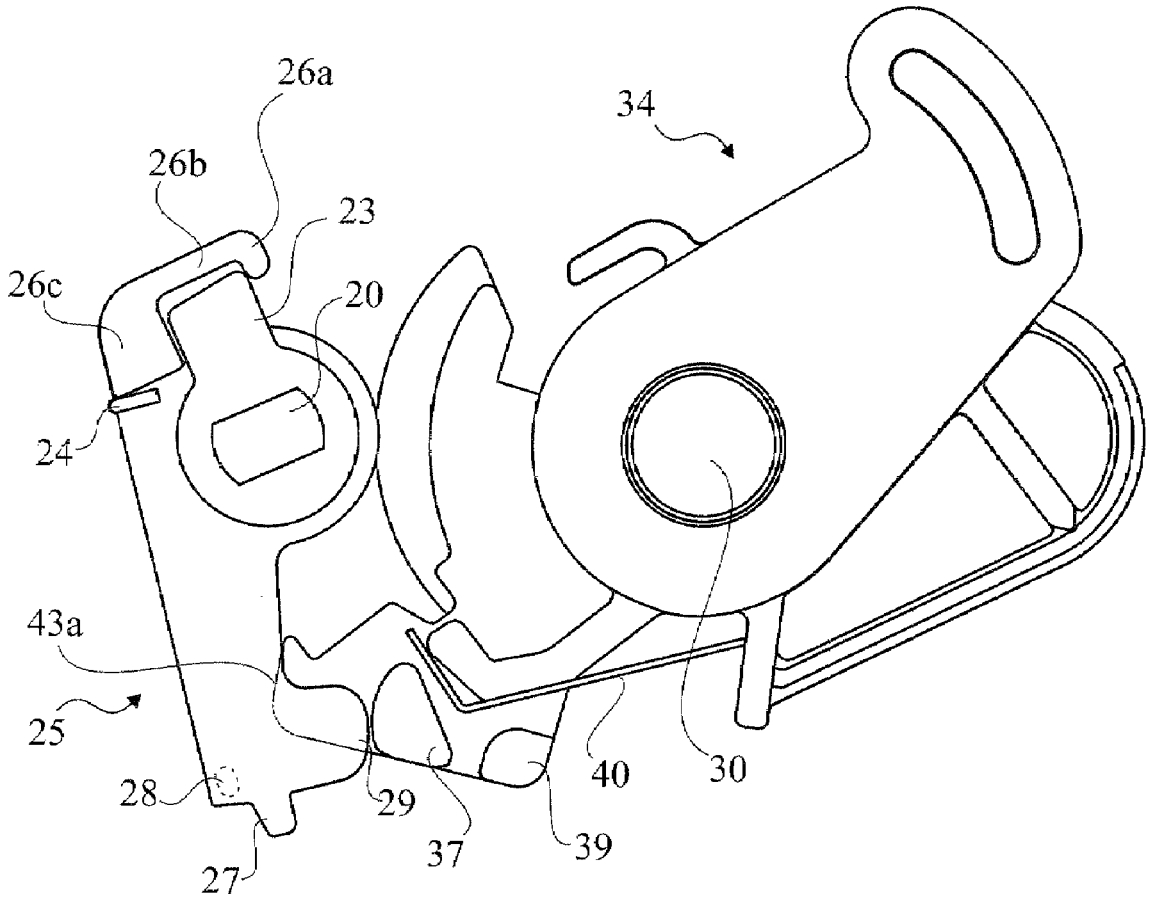
FIG. 8 shows the choke valve lever engaging the throttle valve lever.
Figure 9:
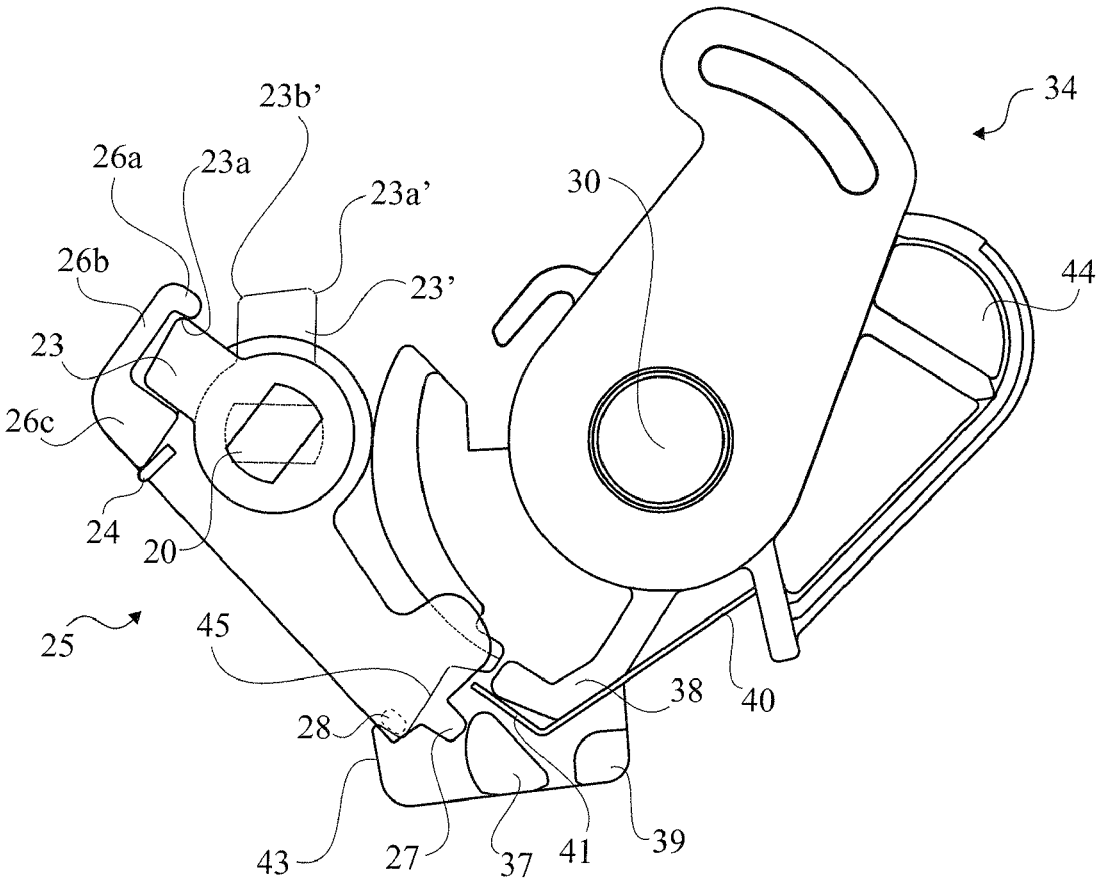
FIG. 9 shows the choke valve and the throttle valve interlocked in a normal choke position.
Figure 10:
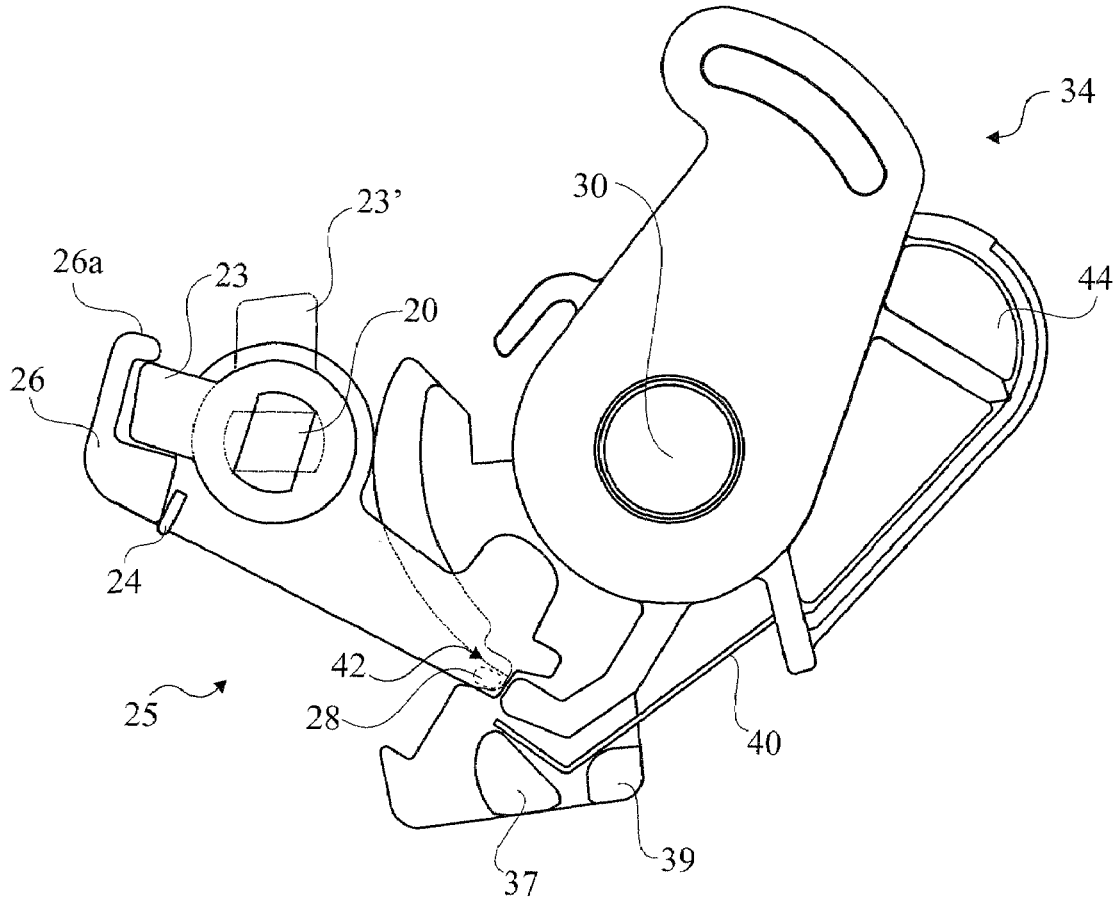
FIG. 10 shows the choke valve and the throttle valve interlocked in a cold start choke position.

When the choke valve lever 25 is pivoted counter clockwise, i.e. when the choke actuator handle 11 is pushed in the upward direction 53, from the position of FIG. 4 at the choke actuator side and the corresponding position of the opposite side seen in FIG. 7, towards the choke position of FIG. 5 and the corresponding position of the opposite side as seen in FIG. 9 or FIG. 10, the pushing tab 29 eventually reaches the position shown in FIG. 8, where it meets the leftmost support 37 which meeting surface is convex. Continuing pursuing the pivot movement of the choke lever 25 the throttle valve lever 34 is pivoted counter clockwise as the pushing tab 29 glides along the convex meeting surface of the leftmost support 37. The pushing tab 29 stays in contact with the leftmost support s 37 until the securing tab 28 meets the rear surface 43*a* of the interlocking hook 43. Pivoting the choke lever 25 further the securing tab 28 glides along the rear surface 43*a* affecting the throttle valve lever 34 further pivoting counter clockwise until the pointed edge of the interlocking hook 43 is passed, whereby the throttle lever 34 slightly retracts—clockwise—until the first stable interlock position has been reached with the securing tab 28 and the interlocking hook 43 interlocking the choke valve lever 25 and the throttle valve lever 34 as seen in FIG. 9. If the choke valve lever 25 is continued to be pivoted counter clockwise the securing tab 28 will glide against the straight edge surface 45. If the coil spring free end 41 protrudes out from the support 37, 38 as seen in FIG. 9, i.e., during normal or warm temperature start, the stopping tab 27 meets the coil spring free end 41 and a further counter clockwise pivoting of the choke valve lever 25 is prevented. After releasing the choke actuator 10 the choke valve lever 25 and the throttle valve lever 35 retracts back to the first stable interlocking position. However, if the coil spring free end 41 is retracted as seen in FIG. 10, the securing tab 28 will glide against the straight edge surface 45 until the securing tab 28 enters the interlocking notch 42, whereby the second stable interlocking position has been reached. Finally, when the throttle valve lever 34 is activated by the user, the spring loaded choke valve lever 25 will be released and rotate back to its original position as of FIG. 7.

FIG. 3-6 describes the function of the choke actuator 9. Here referring to pushing the choke actuator handle 11 upwards 53 or downwards 51 should be understood as applying a force perpendicular to the lever arm constituted by the choke actuator handle 11 providing a clockwise respectively counter clockwise pivoting of the choke actuator 9 around the cylindrical holder 3. Pulling the choke actuator handle 11 outwards 50 refers to pulling the choke actuator handle in a direction opposite to the cylindrical holder 3.

In FIG. 3 the choke actuator 9 is in its locked position. When the choke actuator is in its locked position the choke valve is open. There are two possible situations for the choke actuator 9 to be in its locked position: 1) when the choke valve lever 25 and the throttle valve lever 34 at the opposite side of the carburetor 1 are not interlocked, and 2) when the choke valve lever 25 and the throttle valve lever 34 at the opposite side of the carburetor 1 are interlocked and the choke valve conveyor is at the position indicted by the dashed lines labelled 23' in FIGS. 8 and 9, i.e., starting throttle but no choke. In the first situation the throttle max/min limiter arm 32 will move between min and max throttle positions (in the figure min throttle is shown) depending on how the throttle valve lever 34 is actuated by the throttle wire. In the second situation, the throttle max/min limiter arm 32 is slightly pivoted since the throttle valve lever 34 in that case is interlocked with the choke valve lever 25. FIG. 3*a* is a cut out cross section of the choke actuator and the cylindrical holder in the normal position. The arrows 50, 51 indicate the possible alternatives of how to actuate the choke actuator 9 from this position. The downward direction is defined as the direction indicated by the arrow labelled 51 and the outward direction is indicated by the arrow labelled 50. The choke actuator is prevented from a clockwise rotation (rotational direction as defined above seen from the view of FIG. 7-10) since the resulting force between the upper locking sprint surface 18*a* and the corresponding upper holder notch surface 4*a* counteracts a clockwise rotation. But counter clockwise rotation is possible since the resulting force between the inward sloping lower locking sprint surface 18*c* and the corresponding lower holder notch surface 4*c* includes a force component that is directed in the outward direction 50. I.e., if pushing the choke actuator handle 11 downwards 51 the locking sprint 18 is forced outwards, of course the spring force of the compression spring 12 must be overcome. Thus, pushing the handle portion downwards 51 the choke actuator 9 pivots counter clockwise to the position of FIG. 6.

The choke actuator handle 11 can also be pulled out in the outward direction 50 releasing the locking sprint 18 to the position of FIGS. 4 and 4A.

At the position of FIGS. 4 and 4A, the choke actuator handle 11 can be released whereby the compression spring 12 pulls the actuator handle inwards 52, as indicated by the dotted arrow, returning to the locked position of FIGS. 3 and 3A.

Figure 6:
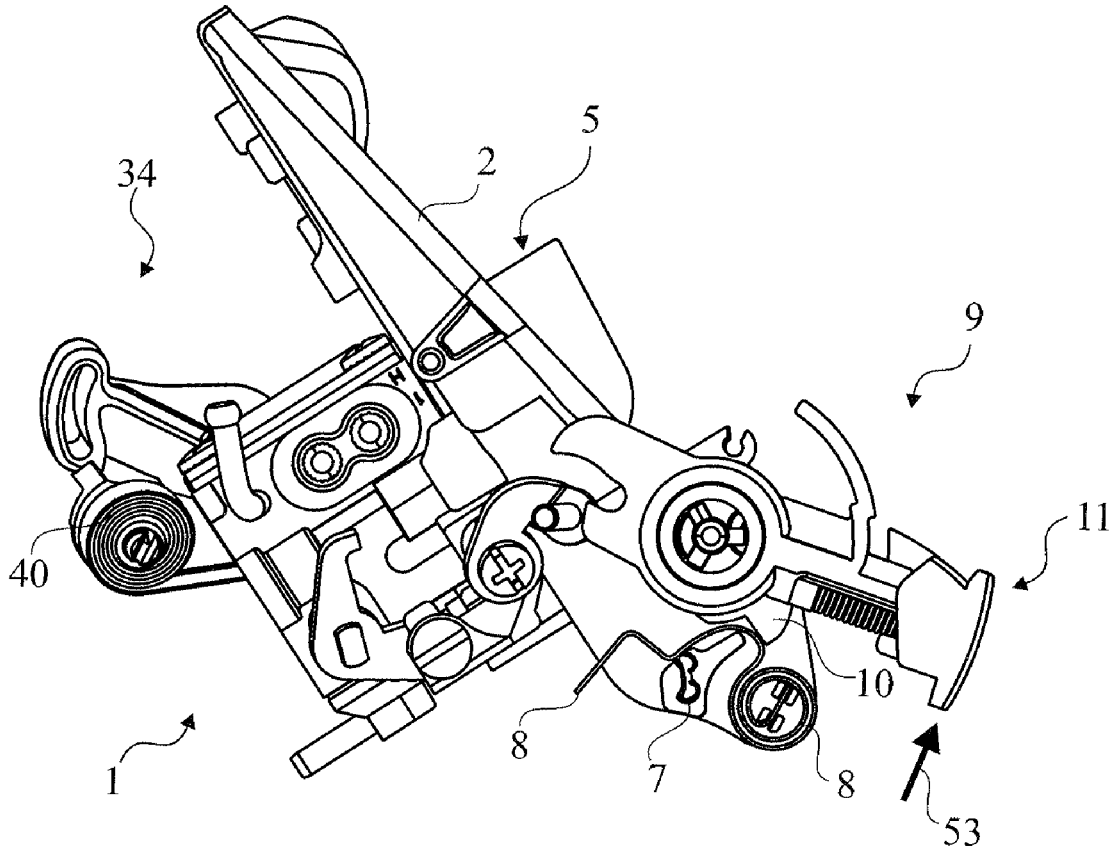
FIG. 6 is a side view of the carburetor, the filter holder and the choke actuator, where the choke actuator functions as a stop button.

Pushing the choke actuator handle 11 downwards 51 the choke actuator 9 pivots counter clockwise to the position of FIG. 6.

Pushing the choke actuator handle 11 upwards 53 the choke actuator 9 pivots clockwise towards the position of FIGS. 5, 5A, whereby the upper part 13*a* of the connecting claw 13 affects the choke valve linkage arm 22 to perform an counter clockwise rotation, whereby the choke valve lever 25 is rotated towards the first or alternatively the second stable interlocking position (FIG. 8 and FIG. 9). If the choke actuator handle 11 is released before the first stable interlocking position (see FIG. 8) has been reached, the choke valve return spring 24 returns the choke valve to its opened position and the choke valve linkage arm 22, which is rotationally fixed to the choke valve axle 20, forces the choke actuator 9 to return to the position of FIG. 3. However, if at least the first stable interlocking position has been reached before releasing the actuator handle 11, the choke actuator 9 stays in the position of FIGS. 5, 5A.

At the position of FIGS. 5, 5A the choke actuator 9 is held in position by the choke valve linkage arm 22, since the choke valve lever 25 is interlocked with the throttle valve lever 34. If the throttle valve lever 34 is actuated by the throttle wire, the interlock is released and the choke actuator 9 is forced to return to the position of FIG. 3 by the choke valve linkage arm 22. If, however, the choke actuator handle 11 is pressed downwards 51 the lower part 13*b* of the connecting claw 13 affects the choke valve linkage arm 22 in clockwise direction, whereby if the actuating force is large enough the choke valve conveyor 23 may escape the grip of detent hook 26, since the choke valve lever 25 is held back by the interlock. I.e., if the conveyor 23 succeeds in escaping the grip of the detent hook 26, the choke valve can be opened, by pivoting the choke actuator 9 towards the position of FIGS. 3, 3A, while maintaining starting throttle due to the interlock between the choke valve lever 25 and the throttle valve lever 34.

Thus to arrive at the choke position, i.e. throttle valve slightly opened and choke valve substantially closed, from the non choke position of FIGS. 3 and 7, i.e. throttle valve closed and choke valve fully opened, the following steps are preformed: The choke actuator handle 11 is pulled out outwards 50 releasing its locking sprint from the holder notch 4 (see FIGS. 4 and 4A); the choke actuator handle 11 is pushed upwards 53 whereby the upper part 13*a* of the connecting claw 13 pivots the choke valve linkage arm 22 counter clockwise affecting the choke valve conveyor 23 through the choke valve axle 20. The choke valve conveyor 23 conveys the choke valve lever 25 to counter clockwise pivot around the choke valve axle 20 whereby eventually the choke valve lever 25 interlocks with the throttle valve lever 34 in the first stable interlocking position of FIG. 9 or alternatively the second stable interlocking position of FIG. 10, depending of the temperature as explained in reference to said figures.

To arrive at the second detent position indicated by the dotted choke valve conveyor 23' in FIG. 9 and FIG. 10, i.e. slightly opened throttle valve and partly to fully opened choke valve, the following steps are performed: The choke actuator handle 11 is pulled out outwards 50 releasing its locking sprint from the holder notch 4. The choke actuator handle 11 is pushed upwards 53 whereby the upper part 13*a* of the connecting claw 13 pivots the choke valve linkage arm 22 counter clockwise affecting the choke valve conveyor 23 through the choke valve axle 20. The choke valve conveyor 23 conveys the choke valve lever 25 to counter clockwise pivot around the choke valve axle 20 whereby eventually the choke valve lever 25 interlocks with the throttle valve lever 34 in the first stable interlocking position of FIG. 9 or alternatively the second stable interlocking position of FIG. 10, depending of the temperature as explained in reference to said figures. The choke actuator handle 11 is pushed downwards 51 whereby the lower part of the connecting claw 13 pivots the choke valve linkage arm 22 and thereby the choke valve conveyor 23. The choke valve conveyor 23 escapes the detent hook 26, as described in above, whereby the choke valve opens. When the choke valve reaches the fully opened position, the actuator handle 11 arrives at its locked position, the locking sprint 18 entering the holder notch 4.

The choke actuator 9 can also be actuated to send a stop signal the engine in a temporary quick stop position of the choke actuator 9. The stop action is performed by pressing the choke handle 11 downwards 51 from its locked position, FIGS. 3, 3A. The locking arrangement 18, 4 prevents an upward push 53 when in locked position as described above, but allows for a downward push 51 without the need of pulling the choke handle 11 outwards 50. As the choke handle is pushed downwards 51 the choke actuator 9 will pivot around the holder 3 to a temporary quick stop position, whereby the pressing member 16 pushes the recoiling second contact 8 towards the first contact 7, whereby a stop signal is sent as the circuit is closes 7, 8. The recoiling contact 8 recoils the choke actuator 9 when the push on the choke actuator 9 is released.

Figure 12:
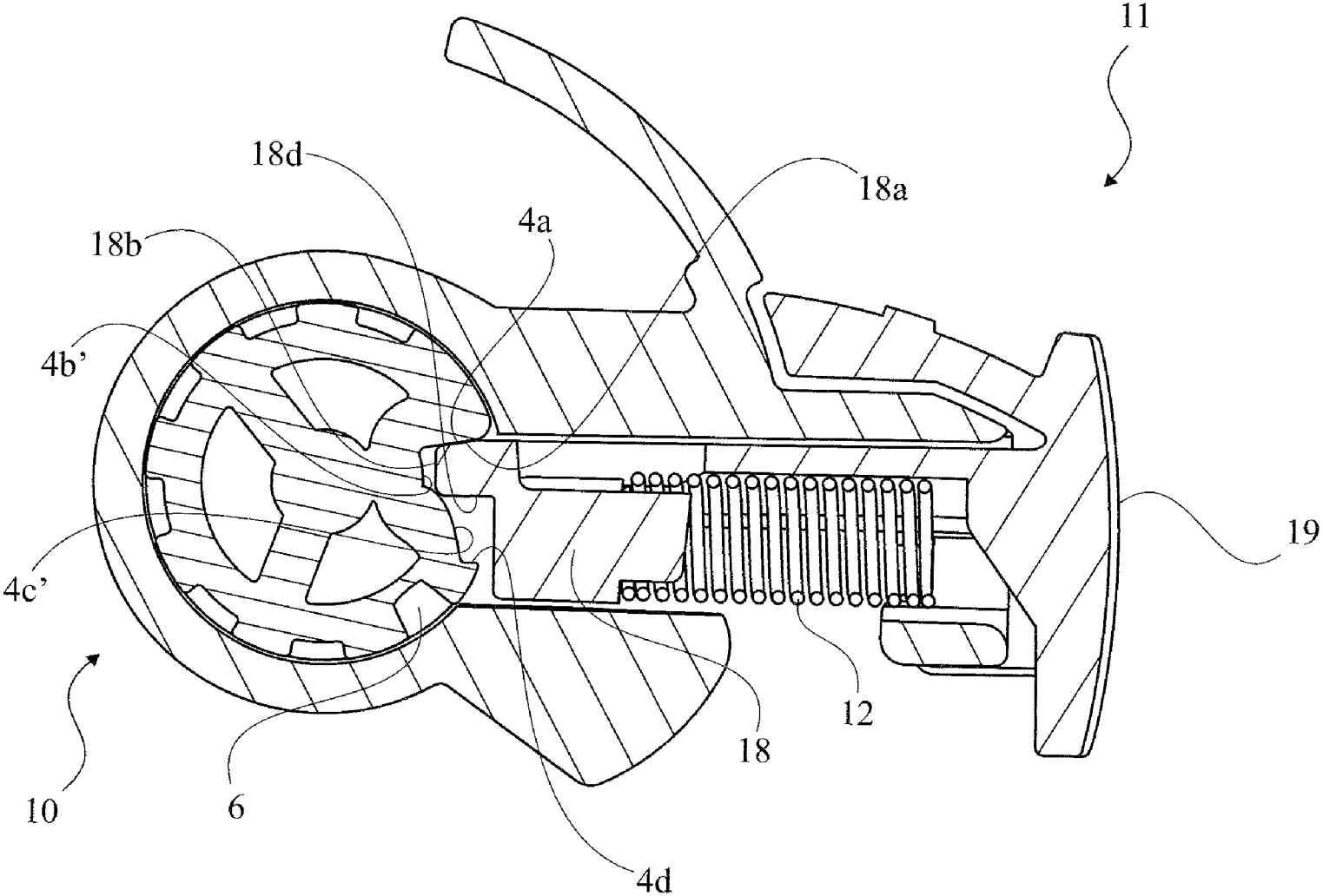
FIG. 12 is a cross section of a second embodiment of the choke actuator and the cylindrical holder.

FIG. 12 shows a second embodiment of the choke actuator 9 and the cylindrical holder 3. Clockwise pivoting is prevented in the same fashion as for the choke actuator 9 described above in reference to FIG. 3-6.

In the second embodiment the locking sprint has a rectangular cross section 18*a*, 18*b*, 18*c* since the lower locking sprint surface 18*c* is not tilted, but parallel to the upper locking sprint surface forming the lower side of a rectangle. For the holder notch 4 the lower notch surface 4*c* is ended towards the perimeter by a stopping portion 4*d* parallel to the upper holder notch surface 4*a*. Pivoting the choke actuator 9 counter clockwise, the corner between the intermediate locking sprint surface 18*b* and the lower locking sprint surface 18*c* will glide along the sloping lower notch surface 4*c*, the choke actuator handle 11 pushed outwards. Eventually the stopping portion 4*d* is reached, the lower locking sprint surface 18*c* and the stopping portion 4*d* facing each other, prevent further pivoting. At this temporary quick stop position the contact elements 7, 8 are arranged to be in contact, closing the circuit and establishing a stop signal to the engine control unit. However the recoiling contact 8 must here be arranged to allow a further pivoting. A second rectangular notch 6 is arranged further down on the cylindrical holder 3 in the counter clockwise direction, providing a locked stop position. The rectangular notch 6 is arranged to fit around the rectangular locking sprint 18*a*, 18*b*, 18*c*. To set the choke actuator 9 in the locked stop position the choke actuator handle 11 must be pulled outwards till the end of the locking sprint 18 is at the perimeter of the cylindrical holder 3, where after the choke actuator 9 can be pivoted counter clockwise to the locked stop position, thereby releasing the choke actuator handle 11 and the locking sprint enters the rectangular notch 6. Thus, according to the second embodiment of the choke actuator 19 and the cylindrical holder 3, a quick stop is provided by pressing the choke actuator handle downwards, but also a secondary locked stop position. Preferably the depth of the rectangular notch 6 is less deep than the holder notch 4 so that the actuator handle 11 is some what extended, whereby the part of the choke actuator body 10 normally covered by the choke actuator handle 11 can be painted in color signalling a locked stop position.

In a further embodiment the quick stop ends in a locked position. This can be achieved by using the choke actuator 9 and the cylindrical holder 3 of FIG. 3A, 4A, 5A, but where a second notch of the same shape as the first notch 4 is added beside the first notch 4 in the counter clockwise direction, so that when pressing the choke actuator handle 11 downwards the choke actuator handle 11 is pushed outwards until it enters the second notch where it retracts back to a locked stop position.

The person skilled in the art should realize that the following solutions are also included within the scope of the invention: As an alternative to the coil spring the thermally responsive member 40 can be formed as a blade of metal. It should however be realized that a certain length of said member is needed to enable a movement sufficient enough to provide the restriction.

It is possible to provide further interlocking positions, for instance having a low temperature interlocking position, a normal temperature interlocking position a high temperature interlocking position with decreasing choke from the low temperature position to the high temperature position. This could e.g. be done by having two thermally responsive members, where the second member is calibrated to reshape at a different temperature than the first one.

Further, the position of the throttle valve can be the same between separate interlock positions, but it may also differ between separate interlock positions.

Further it is realised that the thermally responsive member 40 could also be arranged at the choke valve lever 25 without inflicting the scope of the invention.

It should also be noted that the innovative features of the choke actuator, the detent function and the thermally dependent interlock, all could be implemented independently of each other or in any combination thereof.

In an alternative embodiment the hook parts 26*a*, 26*b* are left out: Instead the first detent position is achieved by having a shallow notch of the cylindrical holder 3 for the locking sprint 18*a*, 18*b*, 18*c* at the choke position of FIG. 5. Of course a small bump on the cylindrical holder could also be used. However, this solution has a similar friction disadvantage as the prior art in relation to novel solution using the detent hook 26, but compared to the prior art the spring, the ball and the notches at the choke axle are not needed.

The invention claimed is:

1. A choke actuator that is pivotally mounted around a cylindrical holder for controlling the choke valve of a carburetor of an internal combustion engine comprising:

a locking mechanism comprising a locking sprint of the choke actuator pressed towards a mating holder notch of the cylindrical holder by a choke actuator spring, thereby allowing the choke actuator to be set in at least one locked position.

2. The choke actuator according to claim 1 wherein the locking mechanism is arranged so that the locking sprint must actively be pulled outwards to unlock the choke actuator in a first rotational direction.

3. The choke actuator according to claim 2 wherein the locking mechanism is arranged so that the locking sprint is pushed outwards when subjected to a pushing force in a second rotational direction unlocking the choke actuator in the second rotational direction.

4. The choke actuator according to claim 1 further comprising a choke valve linkage arm rotationally fixed to a choke valve axle for forcing the choke actuator into a locked position.

5. A method for controlling a choke valve of a carburetor of an internal combustion engine comprising the steps of:

pivoting a choke actuator, which is mounted around a cylindrical holder;

pressing a locking sprint of the choke actuator towards a mating holder notch of the cylindrical holder by a choke actuator spring; and locking the choke actuator in at least one locked position through a locking mechanism comprising the locking sprint of the choke actuator, the cylindrical holder and the choke actuator spring.

6. The method according to claim 5, wherein the locking mechanism is arranged so that the locking sprint must actively be pulled outwards to unlock the choke actuator in a first rotational direction.

* * * * *